US006302814B1

(12) United States Patent
Cade

(10) Patent No.: US 6,302,814 B1
(45) Date of Patent: Oct. 16, 2001

(54) FOOT BAG ON A TETHER

(76) Inventor: Alexander Cade, 176 S. Nardo, Solana Beach, CA (US) 92075

( * ) Notice: Subject to any disclaimer, the term of this patent is extended or adjusted under 35 U.S.C. 154(b) by 0 days.

(21) Appl. No.: 09/526,685

(22) Filed: Mar. 16, 2000

(51) Int. Cl.[7] ..... A63B 39/00; A63B 43/00
(52) U.S. Cl. ..... 473/594; 473/576
(58) Field of Search ..... 473/594, 575, 473/576, 423, 424, 425, 426, 147

(56) References Cited

U.S. PATENT DOCUMENTS 2,186,016 * 1/1940 Evans ..... 473/576
3,186,711 * 6/1965 Morrow ..... 473/575
3,804,409 * 4/1974 Schachner ..... 473/423
4,593,901 * 6/1986 Moore et al. ..... 473/575
4,660,835 * 4/1987 Locurto ..... 473/575
5,054,786 * 10/1991 Solomon ..... 473/575
5,893,811 * 4/1999 Stover et al. ..... 473/575

* cited by examiner

*Primary Examiner*—Steven Wong
(74) *Attorney, Agent, or Firm*—John D. Gugliotta

(57) ABSTRACT

The invention is a foot bag type of product that is attached to the wearer's waist with the use of a flexible plastic spring. The foot bag is of a conventional size, weight and design with the addition of a small swivel hook connected to it. The swivel hook in turn is connected to a long plastic spring, similar in size and elasticity keychain device that is worn around the wrist. At the opposite end of the spring is another swivel joint, a length adjustment, and a connection hook. The connection hook is attached to the wearer's belt or belt loop around the waist.

8 Claims, 2 Drawing Sheets

FOOT BAG ON A TETHER

RELATED APPLICATIONS

The present invention was first described in Disclosure Document Number 463260 filed on Oct. 07, 1999. There are no previously filed, nor currently any co-pending applications, anywhere in the world.

BACKGROUND OF THE INVENTION

1. Field of the Invention

The present invention relates generally to athletic equipment and, more particularly, to a foot kick sack on a tether.

2. Description of the Related Art

The sport/toy industry is a multibillion dollar, global industry that is continually growing as more and more products are developed and introduced to the buying public. The sport/toy industry is somewhat unique in the sense that it is highly susceptible to trendy products or fads. This is due most likely to the fact that children fall easily to peer pressure and, as a result, when a toy product achieves a certain level of popularity from children to adult, demand can skyrocket. This is not necessarily to say that these products require revolutionary or innovative designs. Otherwise conventional products have achieved enormous, even record, popularity based primarily on their attractiveness to the market. Another toy, finding increased popularity in recent times, is that of the foot bag or "HACKY SACK™". While these toys are great fun, they do require a bit of skill before they can be enjoyed. Accordingly, a need has developed for new toys and improvements or even for sport training devices. The foot bag on a tether is such a device.

In the related art, there exists patents for games wherein a toy is attached on the end of a tether attached to the user's waist. None of these patents have a soft, foot bag attached at the end of a elastic, coiled tether as in the present invention.

A search of the prior art did not disclose any patents that read directly on the claims of the instant invention; however, the following references were considered related:

| U.S. Pat. No. | Inventor | Issue Date |
|---|---|---|
| 5,586,760 | Hauter | Dec. 24, 1996 |
| 5,443,576 | Hauter | Aug. 22, 1995 |
| 4,021,035 | O'Hara | May 3, 1977 |
| 4,354,679 | Steinmetz | Oct. 19, 1982 |
| D 386,230 | Gray | Nov. 11, 1997 |
| D 323,539 | Cardoza | Jan. 28, 1992 |
| 5,482,488 | Plummer | Jan. 9, 1996 |
| 4,121,829 | Petrusek | Oct. 24, 1978 |

Consequently, a need has been felt for providing a foot bag on the end of an elastic, coiled tether which automatically recoils after being kicked.

SUMMARY OF THE INVENTION

It is therefore an object of the present invention to provide an improved foot bag toy.

It is an object of the present invention to play games similar to those played with "HACKY SACK™" balls.

It is an advantage of the present invention in that one never has to worry about a bag becoming lost.

It is another advantage of the present invention in that it can be played with little or no skill while still proving effective as a training device.

It is yet another advantage of the present invention that the user never loses control of the foot bag.

It is yet still another advantage of the present invention that the foot bag never rests on the ground.

It is another advantage of the present invention that it will not rust or corrode.

It is yet another advantage of the present invention that the device can be easily carried in the user's pocket while still attached via clips to the belt, belt loops, or buckle of the user.

It is a feature of the present invention that it attaches to the wearer's waist with the use of the belt buckle or belt loop.

It is another feature of the present invention that it can be used inside or out.

It is yet another feature of the present invention that it is available in many different colors.

It is yet still another feature of the present invention that it has no small pieces.

It is another feature of the present invention that it has a plastic spring that is flexible.

It is a benefit of the present invention in that it can also serve as a training aid for conventional "HACKY SACK™" play.

It is another benefit of the present invention that it is an excellent training device for speed and quickness, agility, coordination, balance, and aerobic stamina.

It is yet another benefit of the present invention in that it will not hit others standing nearby.

It is yet still another benefit of the present invention that new games can be invented.

Briefly described according to one embodiment of the present invention, the foot bag on a tether, as its name implies, is a foot bag type of product that is attached to the wearer's waist with the use of a flexible plastic spring. It is similar in nature to a "HACKY SACK™" but with the addition of the spring connection. The foot bag is of a conventional size, weight and design with the addition of a small swivel hook connected to it. The swivel hook in turn is connected to a long plastic spring, similar in size and elasticity to a plastic coil used with keychain devices that go around the wrist and the like. At the opposite end of the spring is another swivel joint, a length adjustment, and a connection hook. The connection hook is attached to the wearer's belt or belt loop around the waist. The length of the spring is adjustable such that regardless of the height of the wearer, the wearer may easily kick the foot bag without allowing the foot bag to drag along the ground. With the foot bag on a tether securely attached and adjusted, the wearer, may kick the foot bag, practice maneuvers, train athletically, and invent new games without fear of the foot bag flying out of control or becoming lost.

BRIEF DESCRIPTION OF THE DRAWINGS

The advantages and features of the present invention will become better understood with reference to the following more detailed description and claims taken in conjunction with the accompanying drawings, in which like elements are identified with like symbols, and in which:

LIST OF REFERENCE NUMBERS

| | | | |
|---|---|---|---|
| 5 | waist belt | 10 | foot bag on a tether |
| 6 | user | 15 | foot bag connector |
| 16a | first swivel | | |
| 16b | second swivel | 18a | belt connector loop |
| 17 | coiled cord | 18b | buckle |
| 17a | first loop | 19 | spring loaded connector |
| 17b | second loop | 19a | third hoop |
| 18 | adjustable length belt | | |

DESCRIPTION OF THE PREFERRED EMBODIMENTS

The best mode for carrying out the invention is presented in terms of its preferred embodiment, herein depicted within the Figures.

1. Detailed Description of the Figures

Figure 1:
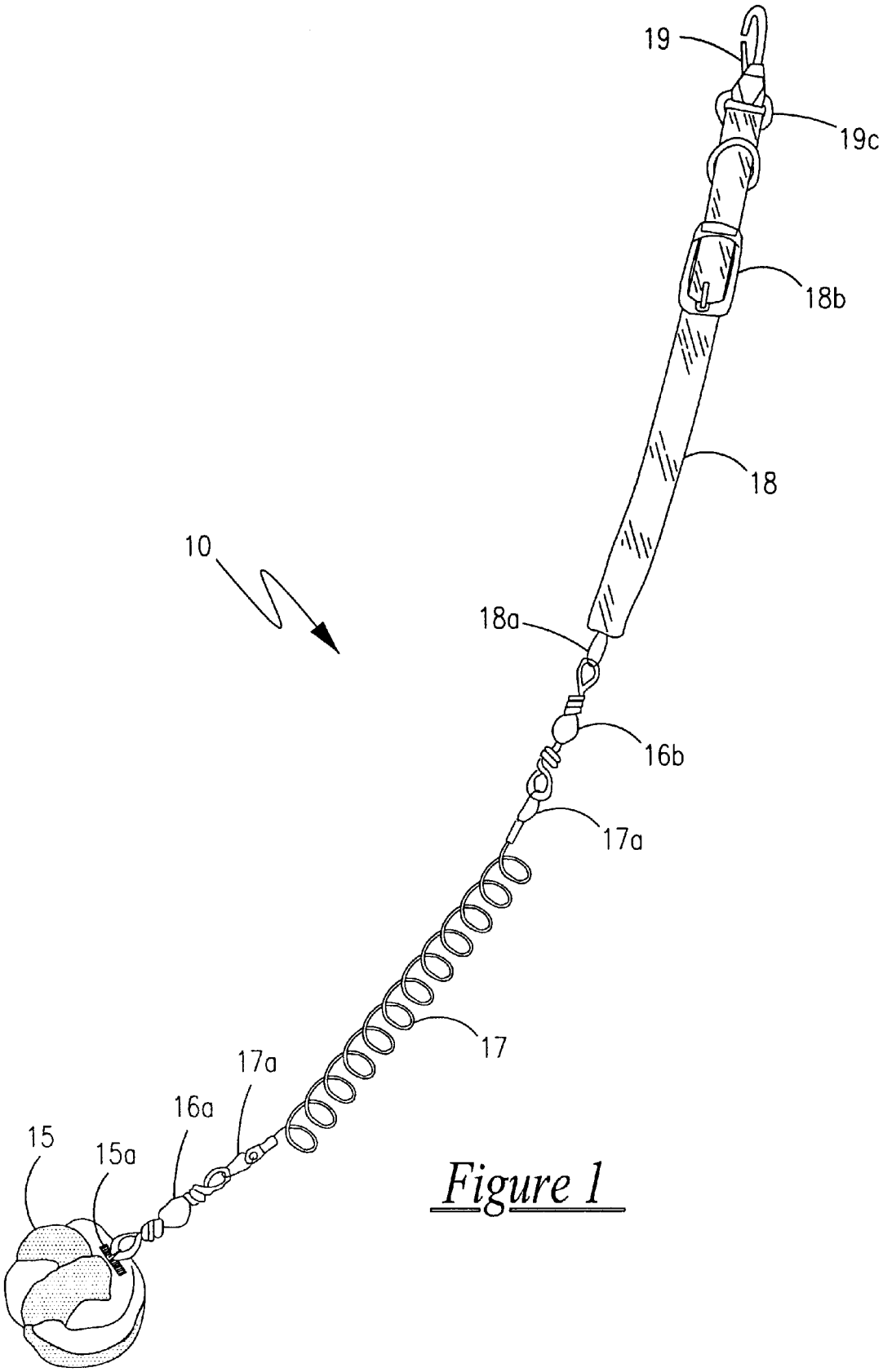
FIG. 1 shows a perspective view of a foot bag on a tether, according to the preferred embodiment of the present invention.
Figure 2:
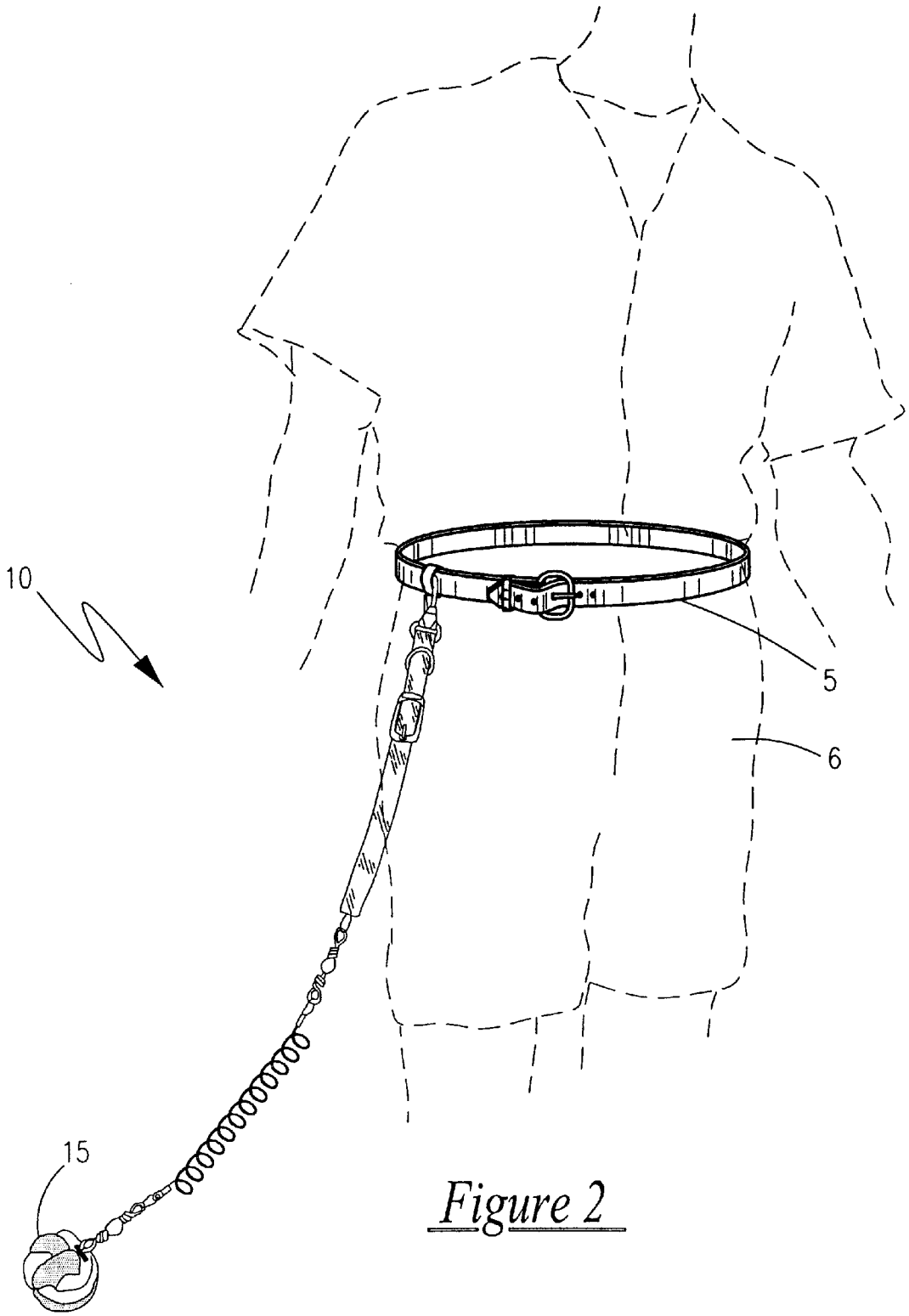
FIG. 2 shows a perspective view of a foot bag on a tether attached to the waist of the user via the user's belt, according to the preferred embodiment of the present invention.

Referring to FIGS. 1 and 2, shown is a perspective view of a foot bag on a tether 10 attached to the waist of a user 6 via the user's belt 5. Essentially, the device 10 consists of a soft, sphere shaped foot bag 15 made of cloth and sewn shut filled with beans and pellets and the like for absorbing the impact of a kick from the foot of a user 6. Foot bag 15 is connected to the bottom end of an elongated coiled cord 17 via a first swivel 16. A small loop 15*a* sewn on the top surface of foot bag 15 provides a connection point for first swivel 16. First swivel 16 connects to the bottom end of coiled cord 17 via a first loop 17*a* that connects to an eyelet formed on the bottom end of coiled cord 17. The top end of coiled cord 17 is connected to an adjustable length belt connector 18 via a second swivel 16. The top end of coiled cord 17 also has an eyelet formed on it and connects to second swivel 16 via the eyelet and a second loop 17*b*. Second swivel 16 is connected to adjustable length belt connector 18 via a belt connector loop 18*a* on the bottom end of adjustable length belt connector 18. Adjustable length belt connector 18 is of the nylon web belt type being variable in length by adjusting a buckle 18*b* and allows for adjustment for different height users. A spring loaded connector 19 is then attached to the top end of adjustable length belt connector 18 connecting foot bag on a tether 10 to the user's belt loop or belt 5 (not part of the disclosure). Coiled cord 17 is made from an elastic type material having a small diameter and capable of expanding up to a length of approximately two to two and one-quarter feet and springably retracting to a length less than one foot.

2. Operation of the Preferred Embodiment

In operation, the coiled cord is attached to the belt on the waist of a user via a spring loaded connector and an adjustable length belt connector. To adjust for varying user heights, the user simply unbuckles the buckle and adjusts the length as with a conventional belt. The foot bag attached to the other end of the coiled cord is then either tossed, dropped, or kicked from the extended position. If the user kicks the bag successfully, the bag is propelled away from the body of the user until the coiled cord is fully extended. Once fully extended, the coiled cord retracts the foot bag back towards the user. The user then once again attempts to kick the foot bag. This process is repeated over and over. If the user misses the foot bag, the foot bag falls and is pulled back towards the user after the coiled cord is fully extended. The user has the opportunity to kick the foot bag again and restart the cycle when the foot bag begins to fall to the ground.

The foregoing description is included to illustrate the operation of the preferred embodiment and is not meant to limit the scope of the invention. The scope of the invention is to be limited only by the following claims.

What is claimed is:

1. A foot kick sack amusement and athletic training device for a user, comprised of:

a sphere shaped foot bag, said foot bag being soft, made from cloth, and sewn shut filled with beans and pellets for absorbing the impact of a kick from the foot of the user;

an elongated coiled cord, said elongated coiled cord having a top end and a bottom end, wherein said bottom end is connected to said foot bag via a first swivel joint;

an adjustable length belt connector, said adjustable length belt connector having a top end and a bottom end, wherein said bottom end of said adjustable length belt connector is connected to said top end of said coiled cord via a second swivel;

a spring loaded connector, said spring loaded connector attached to the top end of said adjustable length belt connector for connecting said device to the user's belt loop or belt.

2. The foot kick sack amusement and athletic training device for a user of claim 1, wherein a small loop sewn on a top surface of said foot bag provides a connection point for said first swivel.

3. The foot kick sack amusement and athletic training device for a user of claim 2, wherein said first swivel connects to an eyelet formed on the bottom end of said coiled cord via a first loop.

4. The foot kick sack amusement and athletic training device for a user of claim 3, wherein an eyelet is formed on the top end of said coiled cord and connects said top end of said coiled cord to said second swivel via a second loop and a belt connector loop connects the bottom end of said adjustable length belt connector to said second swivel.

5. The foot kick sack amusement and athletic training device for a user of claim 4, wherein a said spring loaded connector is of the quick release type and is attached to the top end of said adjustable length belt connector.

6. The foot kick sack amusement and athletic training device for a user of claim 5, wherein said adjustable length belt connector is of the belt type and being variable in length by adjusting a buckle for allowing adjustment for different height users.

7. The foot kick sack amusement and athletic training device for a user of claim 6, wherein said coiled cord is made from an elastic type material having a small diameter and capable of expanding up to a length of approximately two to two and one-quarter feet and springably retracting to a length less than one foot.

8. The foot kick sack amusement and athletic training device for a user of claim 7, wherein said first swivel allows said foot bag to be removed for replacement.

* * * * *